US012163381B2

(12) United States Patent
Bakken et al.

(10) Patent No.: US 12,163,381 B2
(45) Date of Patent: Dec. 10, 2024

(54) METHOD OF INSTALLING CUTTERS ON A DRILL BIT

(71) Applicants: Gary J Bakken, Edmonton (CA); Mike Zulak, Spruce Grove (CA)

(72) Inventors: Gary J Bakken, Edmonton (CA); Mike Zulak, Spruce Grove (CA)

( * ) Notice: Subject to any disclaimer, the term of this patent is extended or adjusted under 35 U.S.C. 154(b) by 37 days.

(21) Appl. No.: 18/107,479

(22) Filed: Feb. 8, 2023

(65) Prior Publication Data

US 2023/0265717 A1 Aug. 24, 2023

Related U.S. Application Data

(60) Provisional application No. 63/311,860, filed on Feb. 18, 2022.

(30) Foreign Application Priority Data

May 31, 2022 (CA) ..... CA 3161043

(51) Int. Cl.

| | |
|---|---|
| ***E21B 10/55*** | (2006.01) |
| ***E21B 10/54*** | (2006.01) |
| ***E21B 10/567*** | (2006.01) |
| ***E21B 17/10*** | (2006.01) |

(52) U.S. Cl.
CPC ..... *E21B 10/54* (2013.01); *E21B 10/55* (2013.01); *E21B 10/567* (2013.01); *E21B 17/1085* (2013.01)

(58) Field of Classification Search
CPC ..... E21B 10/55; E21B 17/1085
See application file for complete search history.

(56) References Cited

U.S. PATENT DOCUMENTS

| | | | |
|---|---|---|---|
| 3,187,739 | A | 6/1965 | Du Fresne |
| 3,666,185 | A | 5/1972 | Williams |
| 4,721,356 | A | 1/1988 | Lyman |
| 4,962,893 | A | 10/1990 | Bochmann et al. |
| 5,049,164 | A | 9/1991 | Horton et al. |
| 5,385,307 | A | 1/1995 | Azar |
| 6,824,086 | B1 | 11/2004 | Mazurkiewicz et al. |
| 7,234,550 | B2 | 6/2007 | Azar et al. |

(Continued)

FOREIGN PATENT DOCUMENTS

| | | | |
|---|---|---|---|
| CA | 2276473 | A1 | 12/2000 |
| GB | 2005562 | A | 4/1979 |

(Continued)

*Primary Examiner* — Kristyn A Hall
(74) *Attorney, Agent, or Firm* — Nathan V. Woodruff

(57) ABSTRACT

Cutting elements are installed on the outer surface of a drill bit body such that the surface profile supports the plurality of cutting elements in a desired orientation. Each cutting element has a substrate with a rear end, a leading end that carries a cutting portion, and a cylindrical surface therebetween. The cutting elements are installed within a cavity on the drill bit body such that a portion of the substrate is exposed and the leading end leads the cutting element in a direction of rotation of the drill bit body. The cutting elements are bound on the outer surface by applying a composite to the outer surface and to the portion of the substrate that is exposed. The composite is a mixture of a matrix and cutting fragments and is in direct contact with about 40-75% of the surface area of the substrate.

12 Claims, 4 Drawing Sheets

(56) References Cited

U.S. PATENT DOCUMENTS

| | | | | |
|---|---|---|---|---|
| 7,297,418 | B2 | 11/2007 | Watson | |
| 7,416,141 | B2 | 8/2008 | Dobbs | |
| 8,079,428 | B2 | 12/2011 | Lyons et al. | |
| 2004/0110395 | A1 | 6/2004 | Ueda et al. | |
| 2006/0217258 | A1 | 9/2006 | Zhao | |
| 2008/0029625 | A1 | 2/2008 | Talton | |
| 2009/0170414 | A1 | 7/2009 | Ferrell et al. | |
| 2011/0000715 | A1* | 1/2011 | Lyons | E21B 10/46 175/428 |
| 2014/0246249 | A1* | 9/2014 | Cheng | B23P 15/28 175/426 |
| 2020/0291726 | A1 | 9/2020 | Lyles et al. | |

FOREIGN PATENT DOCUMENTS

| | | | |
|---|---|---|---|
| GB | 2073048 | A | 10/1981 |
| WO | 2009061353 | A2 | 5/2009 |

* cited by examiner

METHOD OF INSTALLING CUTTERS ON A DRILL BIT

TECHNICAL FIELD

This relates drill bits, and methods of dressing drill bits with hard surfaces.

BACKGROUND

PDCs are used to provide a hard working surface on drill bits or mills that may be used in downhole operations. Poly-crystalline diamond cutters (PDCs) are well known and often used in the manufacture of drill bits suitable for the above mentioned applications.

Due to the immense stress forces encountered during drilling, PDCs installed on drill bits typically become irreparably damaged during use and must be replaced to ensure the efficacy of drill bits. Installing PDCs on a drill bit, whether the first time or when refreshing the drill bit, may be referred to as dressing the drill bit. The PDCs are installed to enhance the strength of the bond between the PDCs and the drill bit in order to prevent their breakage or removal during use, taking into consideration the time required to install the PDCs.

An example of a drill bit that uses PDCs is depicted in U.S. Pat. No. 9,811,630 entitled "Multilevel force balanced downhole drilling tools and methods".

SUMMARY

According to an aspect, there is provided a method of installing cutters on a drill bit, the method comprising the steps of providing a drill bit body having an outer surface, the outer surface comprising a surface profile that is adapted to receive and support a plurality of cutting elements, installing cutting elements on the outer surface of the drill bit body such that the surface profile supports the plurality of cutting elements in a desired orientation, each cutting element comprising a substrate comprising a rear end, a leading end that carries a cutting portion, and a cylindrical surface that extends between the rear end and the leading end, the cutting elements being installed such that a portion of the substrate is exposed and the leading end leads the cutting element in a direction of rotation of the drill bit body, binding the cutting elements on the outer surface of the drill bit body by applying a composite to the outer surface and to the portion of the substrate that is exposed, the composite comprising a mixture of a matrix and cutting fragments and wherein the composite is in direct contact with about 40-75%% of a surface area of the substrate.

According to other aspects, the method may comprise one or more of the following features, alone or in combination: wherein the surface profile may comprise a plurality of indents, and the step of installing cutting elements on the outer surface may comprise placing the cutting elements within the plurality of indents; the composite may be applied between adjacent cutting elements; the cutting fragments may comprise cutting portion fragments carried by substrate fragments; the substrate may comprise carbide and the cutting portion comprises poly-crystalline diamond; and the composite may be in direct contact with about 45-55% of the surface area of the substrate.

According to an aspect, there is provided a drill bit, comprising a drill bit body having an outer surface, the outer surface comprising a surface profile that is adapted to receive and support a plurality of cutting elements, cutting elements installed on the outer surface of the drill bit body such that the surface profile supports each cutting element in a desired orientation, each cutting element comprising a substrate comprising a rear end, a leading end that carries a cutting portion, and a cylindrical surface that extends between the rear end and the leading end, the cutting elements being installed such that the a portion of the substrate is exposed and the leading end leads the cutting element in a direction of rotation of the drill bit body, and a composite applied to the outer surface and to the portion of the substrate that is exposed, the composite comprising a mixture of a matrix and cutting fragments, wherein the composite binds the cutting elements to the outer surface of the drill bit body and the composite is in direct contact with about 40-75% of a surface area of the substrate.

According to other aspects, the drill bit may comprise one or more of the following features, alone or in combination: the surface profile may comprise a plurality of indents sized to receive one cutting element; the composite may be applied between adjacent cutting elements; the cutting fragments may comprise cutting portion fragments carried by substrate fragments; the substrate may comprise carbide and the cutting portion comprises poly-crystalline diamond; and the composite may be in direct contact with about 45-55% of the surface area of the substrate.

According to an aspect, there is provided a method of replacing cutting elements on a drill bit, the method comprising the steps of heating a drill bit body that has used cutting elements bound to an outer surface of the drill bit body by a composite, the used cutting elements engaging the outer surface such that a surface profile of the outer surface of the drill bit body supports each cutting element, the composite comprising a mixture of a matrix and cutting fragments, wherein at least a portion of the cutting elements are spent cutting elements, removing the composite from the spent cutting elements to unbind spent cutting elements, installing replacement cutting elements to replace the removed spent cutting elements, and binding the replacement cutting elements to the outer surface by applying composite to about 40-75% of a substrate of the replacement cutting elements.

According to other aspects, the method may comprise one or more of the following features, alone or in combination: the replacement cutting elements may be cylindrical and may comprise a substrate having a rear end and a leading end that carries a cutting portion, the replacement cutting elements being installed such that the substrate engages the outer surface with a portion of the substrate exposed and the leading end leads the replacement cutting element in a direction of rotation of the drill bit body; and composite may be applied to about 45-55% of the surface area of the substrate of the replacement cutting elements.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION OF PREFERRED EMBODIMENTS

Figure 1:
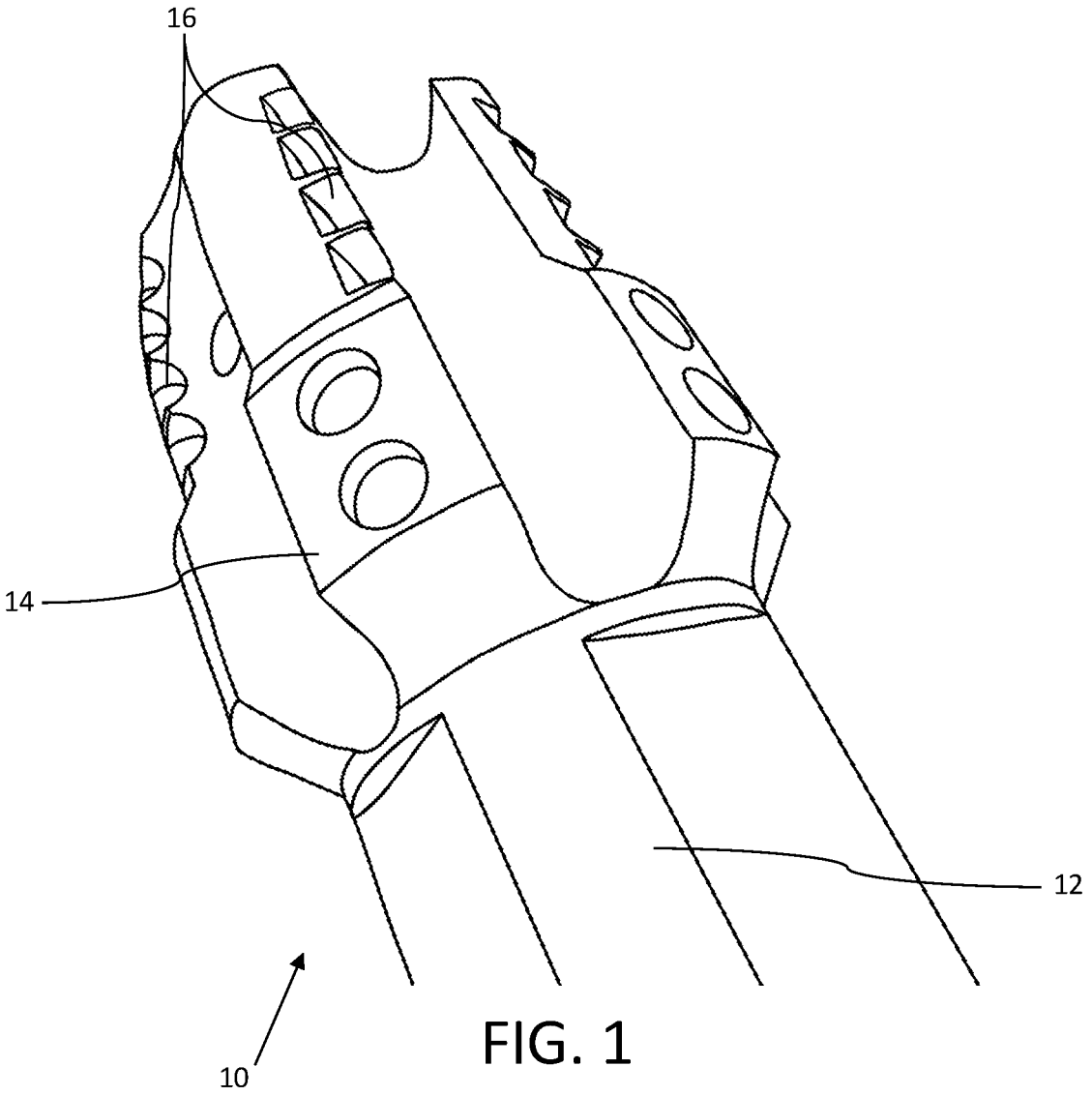
FIG. 1 is a perspective view of a drill bit body without cutting elements.

A drill bit, generally identified by reference numeral 10, will now be described with reference to FIG. 1 through 4. Drill bit 10 is typically used in subterranean drilling operations, such as oil and gas wells.

Figure 2:
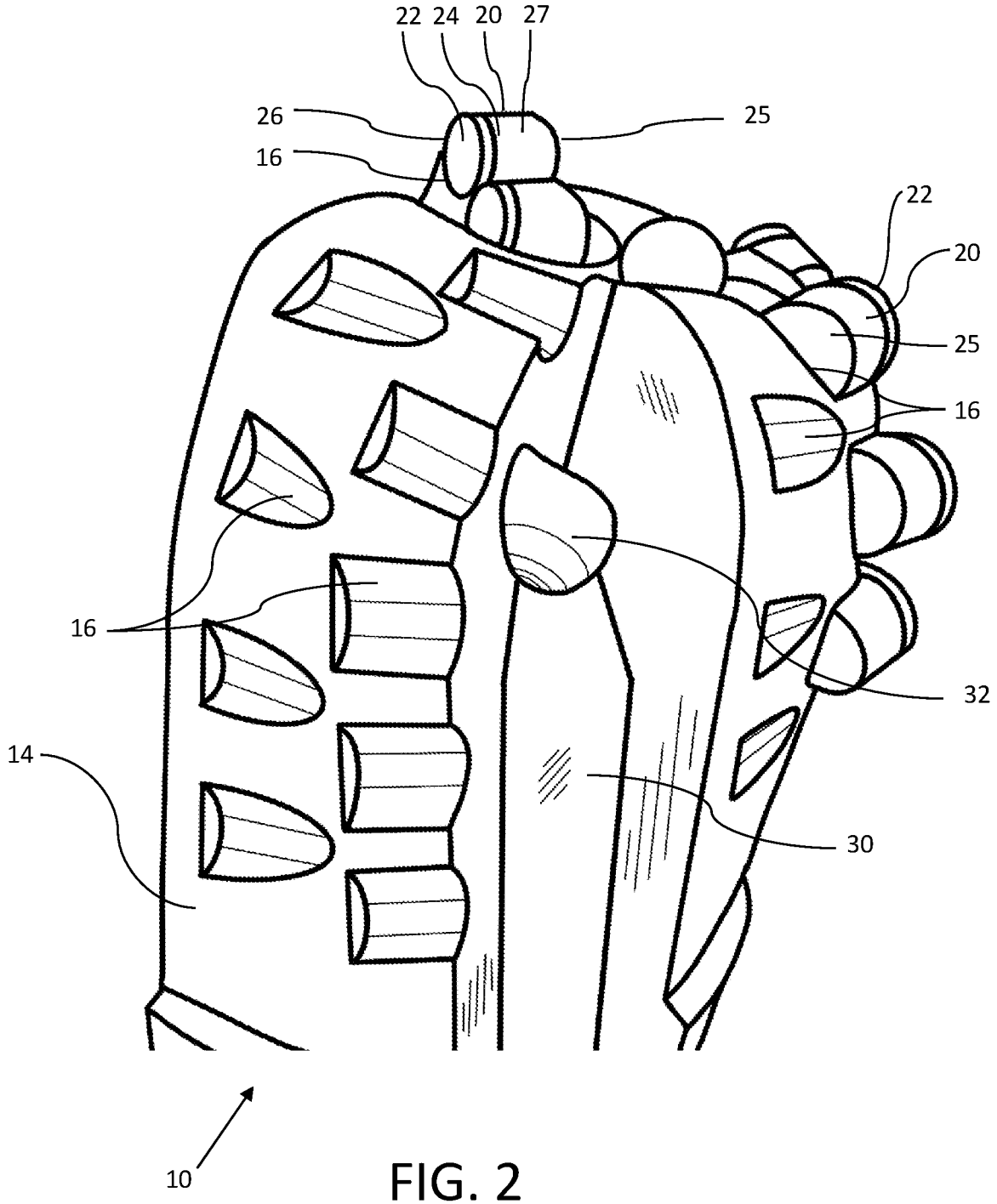
FIG. 2 is a perspective view of a drill bit body with indents partially filled with cutting elements.

Referring to FIG. 1, drill bit 10 has a drill bit body 12 with an outer surface 14. Outer surface 14 has a surface profile 18 formed in outer surface 14. Referring to FIG. 2, surface profile 18 may have indents or cavities 16 that are adapted to receive and support cutting elements 202. Indents 16 or pockets that are sized and shaped to support cutting elements 20. To improve the ability to support cutting elements 20, indents 16 may have a similar shape as cutting elements 20, such as a cavity that has a sidewall that matches a portion of a cylinder to match the shape as cutting elements 20, which are typically cylindrical in shape, although other shapes are also possible. Where indents 16 receive a portion of cutting elements 20, indents 16 may be designed to accommodate a specified portion of cutting element 20, such as if cutting elements 20 are an irregular shape other than the depicted cylindrical shape. FIG. 1 depicts drill bit 10 with a surface profile that is a plurality of indents 16 that include various partial cylindrical sections.

Referring to FIG. 2, cutting elements 20 have a substrate 24 with a rear end 25, and a leading end 26 that carries a cutting portion 22, and a cylindrical surface 27 that extends between rear end 25 and leading end 26. Cutting elements 20 are installed on outer surface 14 such that rear end 25 is supported within indent 16, and a leading end 26 that carries a cutting portion 22 extending outward from indent 16, such that leading end 26 leads rear end 25 in the intended rotational direction of drill bit 10. Leading end 26 carries a cutting portion 22 such that cutting element 20 presents a cutting surface as drill bit 10 rotates during use.

When installed in indent 16, a portion of the surface area of cutter 20 is exposed, which includes a portion of the sidewall, and may include a portion of rear end 25. Surface profile 18 may be configured such that cutting elements 20 are oriented at a specific angle relative to a rotational axis of drill bit 10, or positioned at a specific distance from the rotational axis. In this manner, the cutting action of drill bit 10 may be defined based on the portion of drill bit 10 that engages the material being drilled. For example, the leading face of drill bit 10 may have a different cutting action than on the sides of drill bit 10.

As shown, cutting portions 22 may have flat front faces on leading end 26 that cooperate with adjacent cutting elements 20 to act as a cutting edge 28 on drill bit 10. Cutting edge 28 may be adjacent to a channel 30 formed in outer surface 14 that allows drilled materials to flow out of the way of drill bit 10. Channels 30 may include ports 32 that allow drilling fluid to be circulated during a drilling or milling operation. Cutting elements 20 may have different shapes and sizes on the same drill bit 10, and may have different orientations relative to outer surface 14 or axis rotation of drill bit body 12. Cutting portion 22 and substrate 24 may be made from poly-crystalline diamond and a carbide such a tungsten carbide, respectively. Other suitable materials know in the art may be used.

Figure 4:
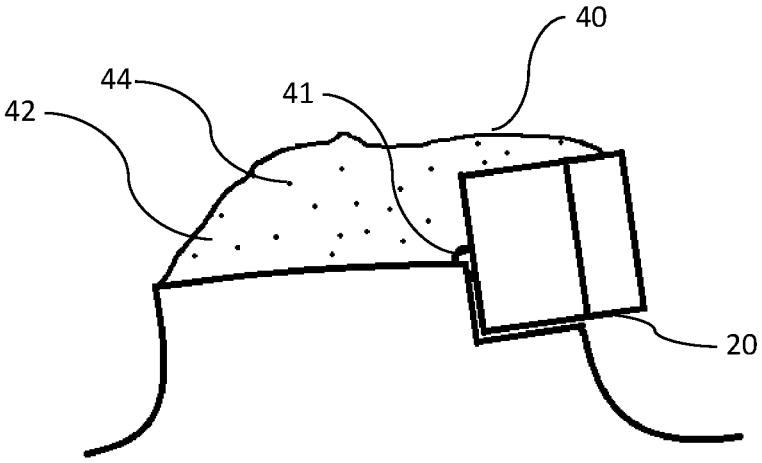
FIG. 4 is an elevated side view in cross section of a cutting element installed within an indent.

Referring to FIG. 4, during installation, cutting elements 20 may be tacked in place so they remain in place as work proceeds. As shown, tacking may include applying solder 41 between outer surface 14 and cutting element 20. Alternatively, or in addition to tacking, the entirety, or portions of outer surface 14 may be tinned, which includes coating outer surface 14 in a solder material. The solder used for tacking or tinning may be a nickel-brass-silver mixture or other suitable solder material. The amount of solder and/or tinning may be modified as required.

Figure 3:
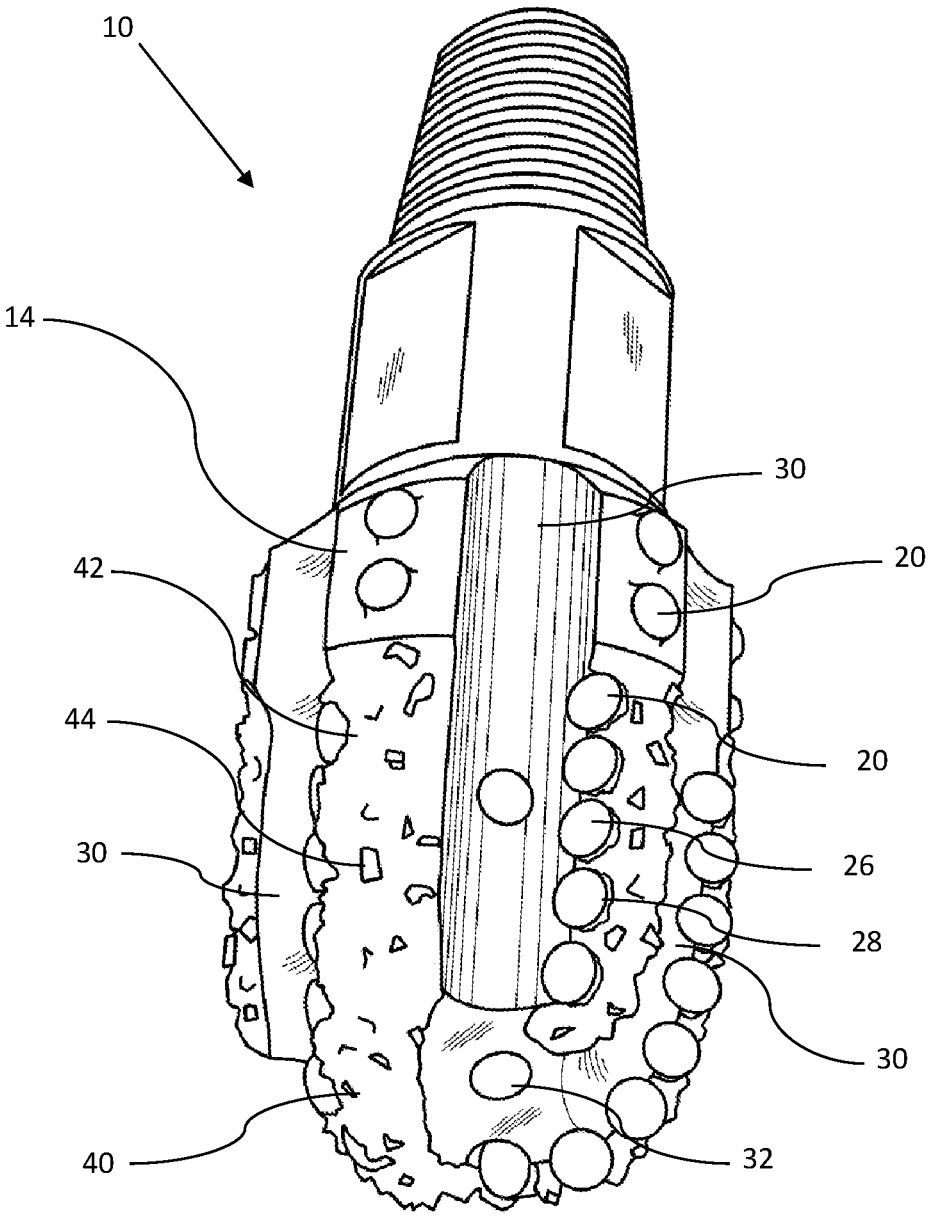
FIG. 3 is an elevated side view of a drill bit with cutting elements and composite.

Referring to FIG. 3, cutting elements 20 are bound on outer surface 14 by a composite 40 that covers a sufficient portion of cutting elements 20 and outer surface 14 such that cutting elements 20 are supported sufficiently against the forces experienced during drilling operations. Composite 40 may be made from a mixture of a matrix 42 and cutting fragments 44 or other pieces of hard materials. When present, cutting fragments 44 may improve the wear characteristics of drill bit 10, and may improve the performance of drill bit 10. Matrix 42 may be a solder material such as nickel-brass-silver solder and cutting fragments 44 may be PDCs similar to cutting elements 20 that have been crushed, such as by using a cryogenic process. When cutting fragments 44 are obtained from crushing PDCs, they may include fragments of poly-crystalline diamonds (i.e. cutting portion 22) and/or tungsten carbide (i.e. substrate 24). Cutting fragments 44 may also be manufactured to a desired size and may be a different material relative to cutting elements 20. Composite 40 may also be matrix 42 or other solder material alone, without additional cutting fragments 44.

Installing composite 40 may involve heating composite 40 until matrix 42 melts and then applying it to outer surface 14 such that composite 40 sufficiently coats outer surface 14 and the exposed portions of substrate 24. Once cooled composite 40 binds cutting elements 20 to outer surface 14. Composite 40 may be applied such that it is in direct contact with around 50% of a surface area of the substrate of cutting elements 20. Composite may be applied such that it is in direct contact with up to about 75% of the surface area of substrate 24, or as little as 40%. The surface area of substrate 24 may be considered to be the rear face of substrate 24 and the sidewall, and typically does not include cutting portion 22. Composite 40 may be localized around cutting elements 20, or it may be applied to the entire outer surface 14 of drill bit 10. Cutting fragments 44 strengthen matrix 42 and allows a thicker layer of composite 40 to be applied relative to matrix alone.

Referring to FIG, composite 40 may be applied so that some or all of cutting portion 22 of cutting elements 20 is exposed. If cutting portion 22 is covered during manufacturing, it will typically wear off to expose cutting portion 22 during use. The thickness of composite 40 may be vary depending on the location on outer surface 14, but is applied thinly enough that it does not interfere with operation of cutting element 20 while acting as a secondary cutting surface.

Drill bit 10 may have different zones on it with different binding conditions for cutting elements 20 within each zone. This may include the position and orientation of cutting elements 20, the type and/or thickness of composite 40. For example, cutting elements 20 may be mounted to indents 16 and bound by composite 40 in certain zones, while in other zones, cutting elements 20 may be oriented such that the plane of cutting portions 22 are aligned with the cutting surface of drill bit 10, such as to act as a bearing surface to center drill bit 10, in which case cutting elements 20 may not be bound to indent 16 using composite 40.

Methods of installing cutter elements 20 and replacing spent cutting elements 20 will now be described.

Referring to FIG. 1, drill bit 10 is provided with a drill bit body 12 and an outer surface 14. Cutting elements 20 are installed on outer surface 14, such as by placing cutting elements 20 into indents 16 such that a portion of substrate 24 is exposed. Cutting elements 20 may be installed in indents 16 such that as little as 25% or as much as 60% of the surface area of substrate 24 is in contact with indents 16. In some examples, about 50% of the surface area was also used. It will be understood that the amount of surface area engaged with indents 16 may vary along outer surface 14 of drill bit. For example, a larger amount of surface area may be desirable at particular points along drill bit body 12, or the amount of surface area may vary depending on the rake angle of cutting elements 20. Referring to FIG. 4, cutting elements 20 may be tacked in place using solder 41. In addition or alternatively, outer surface 14 may be tinned with a layer of material before or after cutting elements 20 are installed. Cutting elements 20 may be installed with a rake angle of about 17-21 degrees, or 15-30 degrees formations have different rake angles, which may vary along outer surface 14 of drill bit body 12. This may be influenced or set by the orientation of indents 16, and may be adjusted during installation using solder or the like.

Once cutting elements 20 are installed, composite 40 is applied to outer surface 14 and the exposed portion of substrate 24 of cutting elements 20 to bind cutting elements on outer surface 14, where composite 40 may be heated above a melting point of matrix 42, such as in the range of 400° C.-700° C., which may depend on the melting point of composite 40, and then applied. This may be done such that composite 40 is in direct contact with about 50% of the surface area of substrate 24, or between about 25-60% of the surface area.

During operations, cutting elements 20 may become spent and lose their cutting efficacy, cutting surface 22 may break away from cutting element 20, or cutting element 20 may break away from drill bit 10. Spent or broken cutting elements 20 may be refreshed or replaced by dressing drill bit 10.

To unbind spent cutting elements, drill bit 10 may be heated to a temperature sufficient to allow removal of composite 40 from substrate 24 of cutting elements 20. All of drill bit 10 may be heated, such as with an induction oven, or only small portions of composite 40 and/or outer surface 14 may be heated, such as with torches, to remove the portion that binds cutting elements 20 to drill bit 10. Once composite 40 has been removed, spent cutting elements 20 may be removed from outer surface 14 and refreshed. Refreshing cutting elements 20 may include completely replacing cutting elements 20 or rotating cutting elements such that an unworn edge of cutting portion 22 becomes the working edge of cutting element 20. This may be done multiple times. For example, cutting elements may be refreshed in this way 2 or more times. Other cutting elements 20 that remain functional and are not spent may be left alone. Composite 40 is then reapplied to bind the new cutting elements 20 within to outer surface 14. Heating only composite 40 to refresh cutting elements 20 may extend the life of drill bit body 12 by reducing the frequency and severity of heating cycles when changing cutting elements 20.

Composite 40 may be the primary holding force for cutting elements 20 and any solder applied to tack cutting elements 20 in place may be insufficient alone to support cutting element during normal operation. In addition, composite 40 acts as a wear surface and protective layer for drill bit body 12. By providing a thick layer of composite 40, or by having cutting elements 20 extend further out from indents 16, the amount of wear experienced by drill bit body 12 and indents 16 may be reduced or avoided, such that the amount of redressing required to build up drill bit body 12 around new cutting elements 20 is also reduced or avoided.

Some pockets may receive less than half the radius of the back of the cutter substrate; preferably less than half the surface area, depending on orientation of the pocket. This may apply to be some, but not all, cutters.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A method of installing cutters on a drill bit, the method comprising the steps of:

providing a drill bit body having an outer surface, the outer surface comprising a surface profile that is adapted to receive and support a plurality of cutting elements;

installing cutting elements on the outer surface of the drill bit body such that the surface profile supports the plurality of cutting elements in a desired orientation, each cutting element comprising a substrate comprising a rear end, a leading end that carries a cutting portion, and a cylindrical surface that extends between the rear end and the leading end, the cutting elements being installed such that a portion of the substrate is exposed and the leading end leads the cutting element in a direction of rotation of the drill bit body; and binding the cutting elements on the outer surface of the drill bit body by applying a composite to the outer surface and to the portion of the substrate that is exposed, the composite comprising a mixture of a matrix and cutting fragments and wherein the composite is in direct contact with about 40-75% of a surface area of the substrate.

2. The method of claim 1, wherein the surface profile comprises a plurality of indents, and the step of installing cutting elements on the outer surface comprises placing the cutting elements within the plurality of indents.

3. The method of claim 1, wherein the composite is applied between adjacent cutting elements.

4. The method of claim 1, wherein the cutting fragments comprise cutting portion fragments carried by substrate fragments.

5. The method of claim 1, wherein the substrate comprises carbide and the cutting portion comprises poly-crystalline diamond.

6. The method of claim 1, wherein the composite is in direct contact with about 45-55% of the surface area of the substrate.

7. A drill bit, comprising;

a drill bit body having an outer surface, the outer surface comprising a surface profile that is adapted to receive and support a plurality of cutting elements;

cutting elements installed on the outer surface of the drill bit body such that the surface profile supports each cutting element in a desired orientation, each cutting element comprising a substrate comprising a rear end, a leading end that carries a cutting portion, and a cylindrical surface that extends between the rear end and the leading end, the cutting elements being installed such that the a portion of the substrate is exposed and the leading end leads the cutting element in a direction of rotation of the drill bit body; and a composite applied to the outer surface and to the portion of the substrate that is exposed, the composite comprising a mixture of a matrix and cutting fragments, wherein the composite binds the cutting elements to the outer surface of the drill bit body and the composite is in direct contact with about 40-75% of a surface area of the substrate.

8. The drill bit of claim 7, wherein the surface profile comprises a plurality of indents sized to receive one cutting element.

9. The drill bit of claim 7, wherein the composite is applied between adjacent cutting elements.

10. The drill bit of claim 7, wherein the cutting fragments comprise cutting portion fragments carried by substrate fragments.

11. The drill bit of claim 7, wherein the substrate comprises carbide and the cutting portion comprises poly-crystalline diamond.

12. The drill bit of claim 7, wherein the composite is in direct contact with about 45-55% of the surface area of the substrate.

* * * * *